United States Patent [19]

Baldwin

[11] Patent Number: 4,962,607

[45] Date of Patent: Oct. 16, 1990

[54] BORE CLEANING TOOL

[76] Inventor: Leon M. Baldwin, P.O. Box 711, Seiling, Okla. 73663

[21] Appl. No.: 404,116

[22] Filed: Sep. 7, 1989

[51] Int. Cl.[5] ..... F41A 29/02

[52] U.S. Cl. ..... 42/95; 15/104.165

[58] Field of Search ..... 42/95, 96; 15/104.16, 15/104.165

[56] References Cited

U.S. PATENT DOCUMENTS

| | | | |
|---|---|---|---|
| 99,557 | 2/1870 | Gillette | 15/104.16 X |
| 172,996 | 2/1876 | Gregg | 15/104.16 |
| 209,276 | 10/1878 | Longden | 15/104.16 |
| 363,951 | 5/1887 | Forster | 15/104.16 |
| 614,191 | 11/1898 | Weills | 15/104.165 |
| 690,393 | 1/1902 | Bishop | 15/104.165 |
| 1,008,548 | 11/1911 | King | 15/104.16 |

*Primary Examiner*—Charles T. Jordan
*Assistant Examiner*—Michael J. Carone
*Attorney, Agent, or Firm*—Bill D. McCarthy

[57] ABSTRACT

A bore cleaning tool is provided which is adapted to receive a cleaning path so that the cleaning patch uniformly contacts the bore defining surface as the tool is moved through a bore. The bore cleaning tool, which is especially adaptable for use in cleaning the bore of a shotgun, includes a support shaft, an elastomeric skirt member supported on the support shaft for engaging the internal bore surface, an elastomeric nose member supported on the shaft in a spatial relationship with the skirt member, and a retainer member for securing the skirt member and the nose member on the support shaft as the bore cleaning tool is moved through the bore.

9 Claims, 1 Drawing Sheet

BORE CLEANING TOOL

BACKGROUND OF THE INVENTION

1. Field of the Invention

The present invention relates to bore cleaning tools, and more particularly, but not by way of limitation, to a bore cleaning tool for shotgun barrels and other similar smooth bore devices.

2. Brief Description of the Prior Art

Proper cleaning of firearms, especially shotguns, is essential for proper maintenance and efficient operation. Moisture often collects along the bore defining surface of a shotgun barrel which results in interior corrosion and pitting of the barrel, and residue from fired shells collects in the barrel, such as powder residue, wad residue, and lead buildup from the shot.

Heretofore, the bore of a shotgun barrel has been cleaned using a push rod having a needle-like eye through which a cleaning patch is threaded. The cleaning patch is generally impregnated with a solvent, lubricant or preservative to assist in the cleaning operation and to protect the bore defining surface of the barrel. The saturated cleaning patch is pushed slowly through the bore from the breech and out the nozzle. Thereafter, another patch is threaded through the needle-like opening of the rod and the rod is moved in a to and fro direction through the bore. The process is repeated, often while rotating the rod, in an effort to contact all of the bore defining surface with the cleaning patch.

While some success has been achieved using the prior art apparatus for cleaning shotgun barrels, a major problem resides in ensuring that all of the bore defining surface is uniformly contacted with the cleaning patch. This is 10 more difficult when the barrel is provided with a choke portion having a reduced diameter from the remaining portions of the barrel. That is, in order to effectively push the cleaning patch through the reduced choke portion of the barrel sufficient cloth is often not available to uniformly contact the enlarged bore of the remainder of the barrel. When such occurs, the bore cleaning surface of the barrel is not adequately cleaned and undetected buildup can occur which will require more severe cleaning techniques like the use of a wire brush and thus cause potential marring of the bore defining surface.

Therefore, a need has long been recognized for improved bore cleaning tools which would permit one to substantially uniformly contact the bore defining surface of a shotgun barrel with a cleaning patch regardless of the dimensions of the choke portion of the barrel. It is to such an improved bore cleaning tool that the present invention is directed.

SUMMARY OF THE INVENTION

According to the present invention an improved bore cleaning tool is provided which, when having a cleaning patch supported thereon, enables the cleaning patch to uniformly contact all of the bore defining surface of a shotgun barrel as the cleaning patch is moved through the bore. Broadly, the bore cleaning tool comprises a support shaft having at least one elastomeric skirt member and an elastomeric nose member colinearly supported on the support shaft, each of the skirt member and nose member having a diameter at least equal to the diameter of the largest portion of the bore.

The skirt member and the nose member, which are retained in a stable position on a forward end portion of the support shaft, are spatially disposed to provide a desired flexibility to the skirt member and the nose member so that when a cleaning patch is supported thereon, uniform contact is maintained between the cleaning patch and the bore defining surface of the barrel.

An object of the present invention is to provide an improved bore cleaning tool capable of supporting a cleaning patch to ensure uniform contact between the bore defining surface and the cleaning patch as the cleaning patch and tool are moved through the bore.

Another object of the present invention, while achieving the before stated object, is to provide an improved bore cleaning tool capable of maintaining uniform contact between a cleaning patch disposed thereover with the bore defining surface of a shotgun as the tool and cleaning patch are passed through the bore.

Yet another object of the invention, while achieving the before stated objects, is to provide an improved bore cleaning tool which, when having a cleaning patch supported thereon, can be moved in a to and fro direction through the bore while ensuring substantially uniform contact of the cleaning patch with the bore defining surface of the bore.

Other objects, features and advantages of the present invention will be apparent from the following detailed description when read in conjunction with the drawings and appended claims.

DETAILED DESCRIPTION

Figure 1:
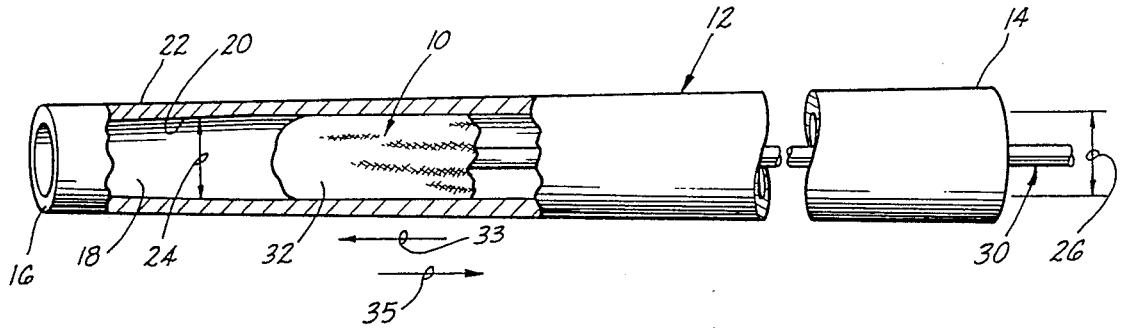
FIG. 1 is a pictorial representation, partially in cross section, of a shotgun barrel wherein a bore is being cleaned by a cleaning patch supported on a bore cleaning tool of the present invention.

Referring now to the drawings, and more specifically, to FIG. 1, a bore cleaning tool 10 of the present invention is illustrated disposed in a bore cleaning position in a barrel 12 of a shotgun (not shown). The barrel 12 is provided with a breech 14, a nozzle 16, and a bore 18 extending therethrough defined by bore defining surface 20. The bore 18 of the barrel 12 is illustrated as being tapered at a choke portion 22 of the barrel 12. That is, the choke portion 22, a modified choke, has a tapering diameter 24 which reduces from a diameter 26 of the bore 18 extending through the remainder of the barrel 12 to the breech 14. The barrel 12 is of conventional construction so further comments concerning the construction of the barrel 12 are not believed necessary herein to understand and appreciate the improvements of the bore cleaning tool 10 of the present invention.

The bore cleaning tool 10 is connectable to a cleaning rod 30 such that the bore cleaning tool 10 can be pushed through the bore 18 from the breech 14 and out the nozzle 16 of the barrel 12. A cleaning patch 32, which may be saturated with a solvent, lubricant or preservative, is disposed about the bore cleaning tool 10. The configuration of the bore cleaning tool 10 ensures that the cleaning patch 32 uniformly contacts the bore defining surface 20 of the barrel 12 as the bore cleaning tool 10 is moved through the bore 18 by the cleaning rod 30. Further, as will become more apparent hereinafter, the configuration of the bore cleaning tool 10 supportingly grips the cleaning patch 32 as the bore cleaning tool 10, and thus the cleaning patch 32, is moved in a to and fro direction in the bore 18 as represented by the arrows 33 and 35 respectively.

Figure 2:
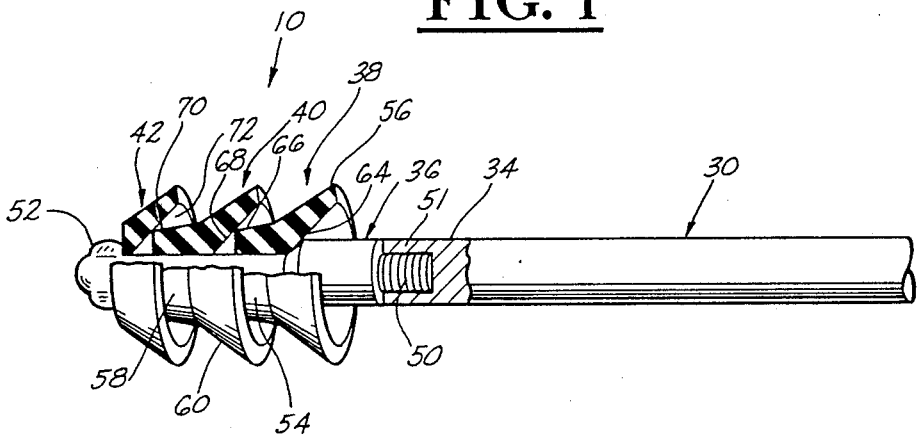
FIG. 2 is a partially cutaway, isometric view of the bore cleaning tool of the present invention connected to a distal end of a conventional cleaning rod.

Referring now to FIG. 2, the bore cleaning tool 10 is illustrated connected to a distal or end portion 34 of the cleaning rod 30. The bore cleaning tool 10 comprises a support shaft 36, a plurality of spatially disposed elastomeric skirt members 38 and 40, and an elastomeric hollow, frusto-conical shaped nose member 42. The skirt members 38, 40, and the nose member 42 are each colinearly supported on the support shaft 36.

Figure 3:
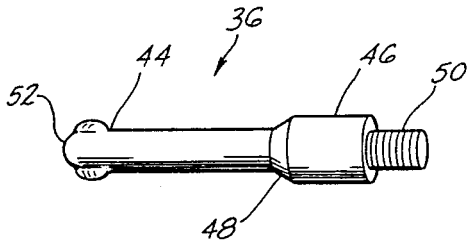
FIG. 3 is an isometric view of a support shaft of the bore cleaning tool of the present invention.

Referring now to FIG. 3, the support shaft 36 is illustrated as having a forward end portion 44, a rearward end portion 46, and a support shoulder 48 formed at the junction of the forward end portion 44 and the rearward end portion 46. The support shoulder 48 serves as a support for the skirt member 38 and thereby stabilizes the skirt member 38 on the support shaft 36. The rearward end portion 46 of the support shaft 36 is provided with suitable means for connecting the support shaft 36 to the cleaning rod 30, such as threads 50 which matingly engage a threaded portion 51 (See FIG. 2) on the end 34 of the cleaning rod 30. A retainer member 52 is supported on the forward end portion 44 of the support shaft 36 for preventing inadvertent removal of the nose member 42, and thus the skirt members 38 and 40, from the support shaft 36 when the bore cleaning tool 10 is withdrawn from the bore 18 of the barrel 12 or moved in the direction 35. Any suitable means can be employed as the retainer member 52, such as an enlarged button shaped member on the forward end portion 44 of the support shaft 36 substantially as shown.

The skirt member 38 is provided with a cylindrically shaped forward portion 54 and a hollow, frusto-conically shaped rearward portion 56; and the skirt member 40 is provided with a cylindrically shaped forward portion 58 and a hollow, frusto-conically shaped rearward portion 60. The skirt members 38 and 40 are identical in construction, and the elastomeric skirt member 38 will be further described with reference to FIG. 4.

As previously stated, the skirt member 38 is provided with the cylindrically shaped forward portion 54 and the hollow, frusto-conically shaped rearward portion 56. The cylindrically shaped forward portion 54 is provided with a longitudinally disposed bore 62 extending therethrough so that the skirt member 38 can be slidably positioned over the retainer member 52 and onto the support shaft 36. A lower end 64 of the cylindrically shaped forward portion 54 abuttingly engages the shoulder 48 of the support shaft 36 so that the skirt member 38 is colinearly supported on the support shaft 36 in a stable position. Thus, the frusto-conical shaped rearward portion 56 of the skirt member 38 extends rearwardly from the support shoulder 48 so as to frictionally engage the bore defining surface 20 of the gun barrel 12 as the bore cleaning tool 10 is moved in to and fro directions 33, 35 in the bore 18 as indicated in FIG. 1.

An upper end 66 of the cylindrically shaped forward portion 54 of the skirt member 38 abuttingly engages a lower end 68 of the cylindrically shaped forward portion 58 of the skirt member 40 substantially as shown in FIG. 2; and an upper end 70 of the cylindrically shaped forward portion 58 abuts an interior portion 72 of the nose member 42. As previously stated, the skirt members 38 and 40 are identical in construction. Thus, the skirt member 40 is also provided with a longitudinally disposed bore extending through the cylindrically shaped portion 58 similar to the bore 62 of the 10 cylindrically shaped forward portion 54 of the skirt member 38.

Figure 5:
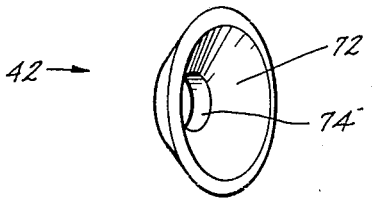
FIG. 5 is an isometric view of an elastomeric nose member of the bore cleaning tool of the present invention.

Referring now to FIG. 5, the hollow frusto-conical shaped nose member 42 is illustrated in more detail. The nose member 42 is provided with a centrally disposed aperture 74 adapted to receive the forward end portion 44 of the support shaft 36 such that the nose member 42 is colinearly supported on the support shaft 36. As previously stated, the nose member 42 abuttingly engages the upper end 70 of the cylindrically shaped forward portion 58 of the skirt member 40. It should be noted that the aperture 74, and the resiliency of the nose member 42, permit one to position the nose member 42 over the retainer member 52 formed on the forward end portion 44 of the support shaft 36.

Figure 4:
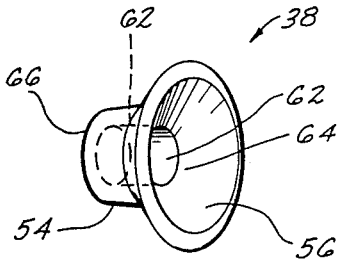
FIG. 4 is an isometric view of an elastomeric skirt member of the bore cleaning tool of the present invention.

Referring more specifically to FIGS. 2, 4 and 5, it should be noted that the hollow, frusto-conical shaped rearward portions 56 and 60 of the skirt members 38, 40, respectively, and the hollow frusto-conically shaped nose member 42, are each provided with a diameter which is at least equal to or greater than the largest diameter 26 of the bore 18 of the barrel 12. Because of the resiliency of the hollow, frusto-conical shaped rearward portions 58, 60 of the elastomeric skirt members 38, 40 and the nose member 42, with the bore cleaning tool 10 inserted into the bore 18 of the gun barrel 12, the sidewalls of the skirt members 38, 40 and the nose member 42 engage the bore defining surface 20 of the gun barrel 12, and these sidewalls are compressed such that the bore cleaning tool 10 uniformly engages the surface 20.

When the cleaning patch 32 is disposed over the bore cleaning tool 10 (that is, in a covering position over the elastomeric nose member 42 and the skirt members 38, 40) the frictional engagement of the rearward portions 58, 60 of the skirt members 38, 40 and nose member 42 with the bore defining surface 20 keeps the cleaning patch 32 on the bore cleaning tool 10 as it is moved through the gun barrel 12. Further, because of the spatial relationship between the skirt members 38, 40 and the nose member 42, and the elastomeric properties of same, the hollow, frusto-conically shaped rearward portions 56 and 60, together with the nose member 42, grip the adjacently disposed portions of the cleaning patch 32 such that the cleaning patch 32 remains in the covering position relative to the bore cleaning tool 10 when the bore cleaning tool 10 is moved in to and fro directions 33, 35.

It is to be understood that the support shaft 36 can be fabricated of any material having the desired rigidity to support the skirt members 38, 40 and the nose member 42. Further, the skirt members 38, 40 and the nose member 42 are preferably fabricated of an elastomeric material, such as natural or synthetic rubber, having the desired resiliency to allow such members to be compressed during movement of the bore cleaning tool 10 through the gun barrel 12. It will be appreciated that many polymeric materials will also be candidates for the selected material of construction of the skirt members 38, 40 and nose member 42.

Because of the desire to obtain frictional engagement between the hollow, frusto-conically shaped rearward portions 56 and 60 of the skirt members 38 and 40 with the bore defining surface 20 of the bore 18, as well as the edges of the nose member 42, the thickness of such members can be reduced at their respective rearward ends so that increased flexibility is provided. Further, by reducing the thickness of the rear ends of such elements, the elements can be deformed in response to changes in the internal diameter of the bore 18 more readily, while at the same time assisting in the movement of the bore cleaning tool 10, and thus the supported cleaning patch 32, in the to and fro directions 33, 35.

It will be clear that the present invention is well adapted to carry out the objects and to attain the advantages mentioned as well as those inherent therein. While a presently preferred embodiment of the invention has been described for purposes of this disclosure, numerous changes can be made which will readily suggest themselves to those skilled in the art and which are encompassed within the spirit of the invention disclosed and as defined in the appended claims.

What is claimed is:

1. A bore cleaning tool for cleaning the internal surface defining a bore, comprising:

a support shaft having a diameter less than the diameter of the bore so that the support shaft can freely travel therethrough;

skirt means supported on the support shaft for engaging the internal surface of the bore; the skirt means comprising:

at least one resilient skirt member supported on the support shaft, the skirt member having a cylindrically shaped forward portion and a hollow frusto-conically shaped rearward portion; and a resilient nose member abuttingly engaging the cylindrically shaped forward portion of an adjacent disposed skirt member, the nose member comprising a frusto-conically shaped member substantially equal in diameter to the diameter of the frusto-conically shaped rearward portion of the skirt member; and retainer means for securing the skirt means on the support shaft, the skirt means compressingly engaging the internal surface along the length of the bore as the support shaft is caused to move through the bore.

2. The bore cleaning tool of claim 1 wherein the support shaft is characterized as having a forward end portion and a rearward end portion, which define a support shoulder at the junction thereof such that the cylindrically shaped forward portion characterized as having a first end and an opposed second end, the first end of the cylindrically shaped forward portion abuttingly engaging the support shoulder such that the frusto-conically shaped rearward portion extends about the support shoulder and wherein the retainer means comprises:

a cap member formed at a distal end of the forward end portion of the shaft.

3. The bore cleaning tool of claim 2 wherein the cylindrically shaped forward portion of the skirt member is provided with a centrally disposed, longitudinally extending bore, and wherein the nose member is provided with a centrally disposed aperture such that the skirt member and the nose member are colinearly supported on the support shaft and the frusto-conically shaped rearward portion of the skirt member and the nose member are stabilized in a spatial relationship relative to each other.

4. A tool for cleaning a bore comprising:

a support shaft having a forward end portion and a rearward end portion, the rearward end portion having a diameter greater than a diameter of the forward end portion so that a support shoulder is formed at the junction of the forward and rearward end portions;

skirt means supported on the forward end portion of the shaft and abuttingly engaging the support shoulder, the skirt means having a diameter at least equal to a diameter of the largest portion of the bore, the skirt means being compressible to permit passage through the bore while engaging the internal surface of the bore substantially throughout the length of the bore, the skirt means comprising:

at least one elastomeric skirt member having a cylindrically shaped forward portion and a hollow, frusto-conical shaped rearward portion, the cylindrically shaped forward portion having a longitudinally extending bore extending therethrough adapted to receive the forward end portion of the support shaft such that the skirt member is colinearly supported on the support shaft and abuttingly engages the support shoulder thereof; and an elastomeric, hollow frusto-conical shaped nose member having a centrally disposed aperture adapted to receive the forward end of the support shaft such that the nose member is colinearly supported on the support shaft and abuttingly engages the cylindrically shaped forward portion of the adjacently disposed skirt member; and cap means connected to a distal end of the forward end portion of the support shaft for securing the skirt means on the support shaft.

5. The tool according to claim 4 further comprising:

means for connecting the rearward end portion of the support shaft to a cleaning rod such that the tool can be moved in a to and fro direction through the length of the bore.

6. A cleaning tool connectable to a cleaning rod and supporting a cleaning patch such that the cleaning patch uniformly contacts the bore defining surface of a shotgun barrel bore as the cleaning patch is moved through the bore, the cleaning tool comprising:

a support shaft having a forward end portion, a rearward end portion, and a support shoulder formed at the junction of the forward end portion and the rearward end portion;

at least one resilient skirt member having a cylindrically shaped forward portion and a hollow, frusto-conically shaped rearward portion, the cylindrically shaped forward portion having a longitudinally extending bore therethrough adapted to receive the forward end portion of the support shaft such that the skirt member is colinearly supported on the support shaft and one end of the cylindrically shaped forward portion abuttingly engages the support shoulder such that the frusto-conically shaped rearward portion of the skirt member extends about the' support shoulder;

a resilient nose member having a centrally disposed aperture adapted to receive the forward end portion of the support shaft such that the nose member is colinearly supported on the support shaft and abuttingly engages an adjacently disposed end of the cylindrically shaped forward portion of the skirt member, the nose member being substantially frusto-conically shaped; and retainer means supported by the forward end portion of the support shaft for securing the skirt member and the nose member to the support shaft.

7. The cleaning tool of claim 6 further comprising:

connector means for colinearly connecting the rearward end portion of the support shaft to the cleaning rod.

8. The cleaning tool of claim 7 wherein the retainer means comprises:

cap means connected to a distal end of the forward end portion of the support shaft for securing the skirt member and the nose member on the support shaft.

9. The cleaning tool of claim 8 wherein the resilient skirt member and the resilient nose member are each fabricated of an elastomeric material.

* * * * *

UNITED STATES PATENT AND TRADEMARK OFFICE

CERTIFICATE OF CORRECTION

PATENT NO. : 4,962,607

DATED : October 16, 1990

INVENTOR(S) : Leon M. Baldwin

It is certified that error appears in the above-identified patent and that said Letters Patent is hereby corrected as shown below:

Cover Sheet - [57] Abstract, line 2, delete "path" and substitute therefor --patch--;

Column 1, line 35, after "is" and before "more" delete "10";

Column 4, line 11, after "the" and before "cylindrically" delete "10"; and

Column 6, line 68, delete "the'" and substitute therefor --the--.

Signed and Sealed this

Second Day of June, 1992

*Attest:*

*Attesting Officer*

DOUGLAS B. COMER

*Acting Commissioner of Patents and Trademarks*